US005547442A

United States Patent [19]

Carballosa et al.

[11] Patent Number: 5,547,442

[45] Date of Patent: Aug. 20, 1996

[54] MULTIPLE EFFECT EXERCISE DEVICE

[76] Inventors: Hector Carballosa, 3301 SW. 139 Ave., Miami, Fla. 33175; Enrique A. Kairus, 9331 SW. 4 St., Apt. 120, Miami, Fla. 33174

[21] Appl. No.: 423,342

[22] Filed: Apr. 17, 1995

[51] Int. Cl.[6] ..... A63B 21/02

[52] U.S. Cl. ..... 482/46; 482/44; 482/123; 482/127; 482/129

[58] Field of Search ..... 482/44, 45, 46, 482/49, 121, 122, 123, 126, 127, 129

[56] References Cited

U.S. PATENT DOCUMENTS 4,570,925 2/1986 Kock et al. ..... 482/46
5,176,601 1/1993 Reynolds ..... 482/123

*Primary Examiner*—Lynne A. Reichard
*Attorney, Agent, or Firm*—Malloy & Malloy, P.A.

[57] ABSTRACT

A multi-effect exercise device to be used to maximize the effects of all manipulations and maneuvers during exercise and to have multiple exercise stimulation effects upon a user during a normal exercise routine, the device including a pair of support rails connected by at least one connector segment whereon a pair of exercise members are secured. Each of the pair of exercise members will include a fore segment and rear segment hingedly secured to one another and pivotally disposed relative to the rear segment such that by gripping a handle grip segment extending from a distal end of the fore segment the fore segment can be pivotally moved towards and away from the rear segment. In order to provide the appropriate exercise effects, movement of the fore segment both towards and away from the rear segment will be resisted, thereby ensuring that work is being done both during a compression and extension stroke of the arm during exercising. Additionally, the handle grip segment is secured to the fore segment such that resisted pivotal movement between the handle grip segment and fore segment as well as resisted torsional movement between the handle grip segment and fore segment is achieved to provide an even greater degree of comfort and exercise to the user.

19 Claims, 1 Drawing Sheet

MULTIPLE EFFECT EXERCISE DEVICE

BACKGROUND OF THE INVENTION

1. Field of the Invention

The present invention relates to a multiple effect exercise device structured to be substantially compact and portable, and provide a user with a convenient and effective device to exercise a variety of arm muscles simultaneously, without excessive strain and without requiring complex adaptation or manipulation in order to exercise the variety of muscles.

2. Description of the Related Art

The field of art relating to exercise devices, and in particular to exercise devices which function primarily to strengthen the arms and upper body, is substantially crowded containing numerous devices specifically designed to strengthen a particular muscle group. In addition to those devices, there are many devices which have a number of uses and are adaptable such that the user can use the same device in a different manner with different configurations in order to achieve different exercises and results. The majority of these devices, however, whether they are employed for exercise or therapeutic purposes are not conveniently portable and are often not structured to maximize the conditioning effects of all movements associated with the exercise. For example, there are variety of devices in the art which incorporate springs or pistons to selectively resist compressive flexing of the arm muscle during arm curls. These devices, however, even if adaptable for use in performing other exercises such as arm extensions, do not make efficient use of the users full range of arm motion for exercise purposes. In particular, when doing arm curls resistance to the movement of the hand towards the shoulder is maintained causing the muscles to work. When, however, the user's arm is being returned to its extended position, that same spring effect which previously resisted movement will in fact aid a rapid return of the arm into a relaxed position. As such, this portion of the individual's arm stroke is wasted unless the user can substantially slow their arm's return to the relaxed position. Not only is the slowed resistance difficult, but it can also substantially extend the time required to accomplish full toning. Also, when portions of the arm, such as the biceps, are being exercised alternative portions such as the user's wrists and forearms are not exercised, thereby requiring additional isolated exercises if those muscles are to be worked.

Accordingly, there is a need in the art for a device which is substantially compact and portable in order to facilitate transporting for continuous use by a user, and which will maximize the exercise motions by enabling the user's arms to remain in a single, appropriate position while effectively performing a variety of exercises rapidly and with maximized simultaneous effects.

SUMMARY OF THE INVENTION

The present invention is directed to a multiple effect exercise device utilized to effectively and efficiently exercise a number of different muscles of a user. The exercise device of the present invention includes a pair of elongate support rails positioned in a spaced apart relation from one another, and secured to one another by at least one connector segment. The connector segment extends between the support rails thereby maintaining them in a desired spaced apart relation, which preferably corresponds the shoulder width of the user.

Secured to each of the support rails is an exercise member. Each exercise member includes a fore segment and a rear segment corresponding the forearm and rear biceps portions of a user's arm. Turning specifically to the fore segment, it includes a proximal end and a distal end, and has a handel grip segment extending from the distal end. The handle grip segment is structured to be griped by the hand of a user during performance of the exercises and is secured to fore segment by fastening means. The fastening means include both biased pivotal and torsional resistances means. The biased pivot resistances means are structured to enable resisted, pivoted movements of the handle grip segment relative to the fore segment upon pivoted movement of the wrist of the user. Similarly, biased torsional resistances means enable resisted, torsional movement of the handle grip segment relative to the fore segment upon torsional movement of the wrist of the user.

The fore segment and the rear segment of the exercise member are hingedly secured to one another and pivotally secured to the support rails to allow for a full range of adjustment and motion. Additionally, in order to ensure proper form and comfort while exercising, variable height support means are included to adjustably dispose the rear segment in one of a plurality of adjusted elevations relative to the support rails. Accordingly, the range of motion can be varied and controlled to correspond the exercise needs of the user as well as the comfort needs of the user.

To achieve multiple exercise effects during pivoted movement of the fore segment relative to the support rails, vertical and horizontal resistance means are included. The vertical resistance means extend between the support rails and the fore segment of the exercise members and are structured to resist movement of the fore segment away from the support rails. The horizontal resistance means are structured and disposed to resist movement of the fore segment away from the rear segments and towards the support rails there beneath. Accordingly, during exercising, the compression arm curl movement is resisted by the vertical resistance means, and the return of the arm to it's extended position is resisted by the horizontal resistance means, thereby, causing a user to maximize the exercise effects of both arm strokes.

It is an object of the present invention to provide a multi-effect exercise device which is substantially compact and portable thereby facilitating transport and use.

Another object of the present invention is to provide a multi-effect exercise device which will work a user's muscles during all phases of the exercise rather than requiring specific isolated adaptations in order to work a single group of muscles at a time.

Yet another object of the present invention is to provide a multi-effect exercise device which can be easily adjusted for use to meet varied strength and physical requirements in an effective and efficient manner.

An additional object of the present invention is to provide a multi-effect device which will enable proper wrist positioning to be maintained during both an extension and a compression exercise stroke, and which will allow for an added range of exercises through its ability to enable resisted wrist manipulation.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
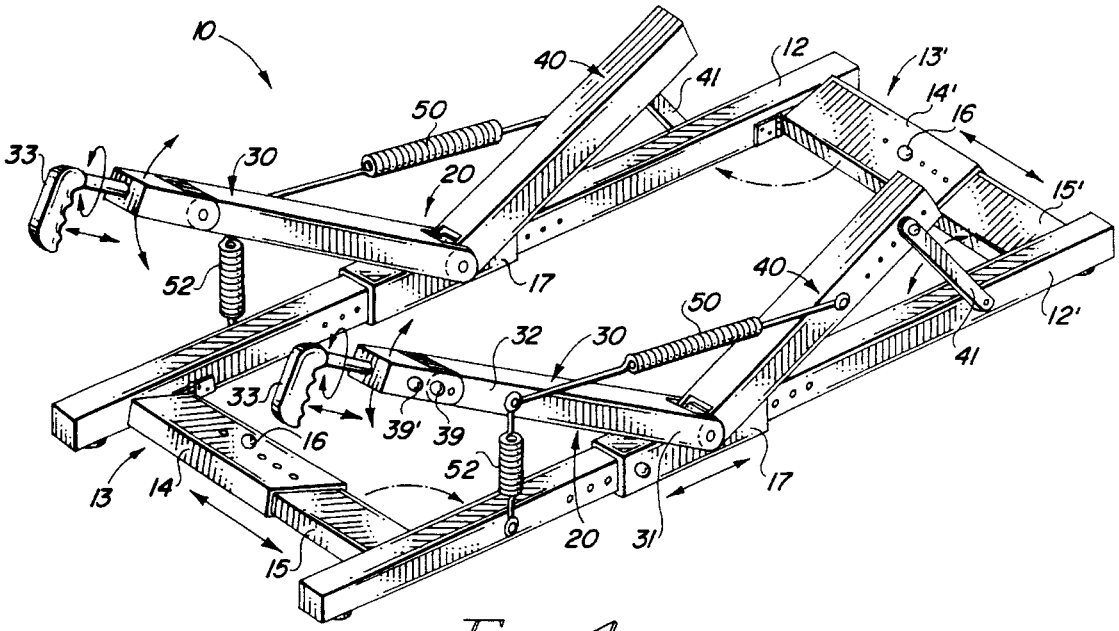
FIG. 1 is a top perspective view of the exercise device of the present invention.
Figure 2:
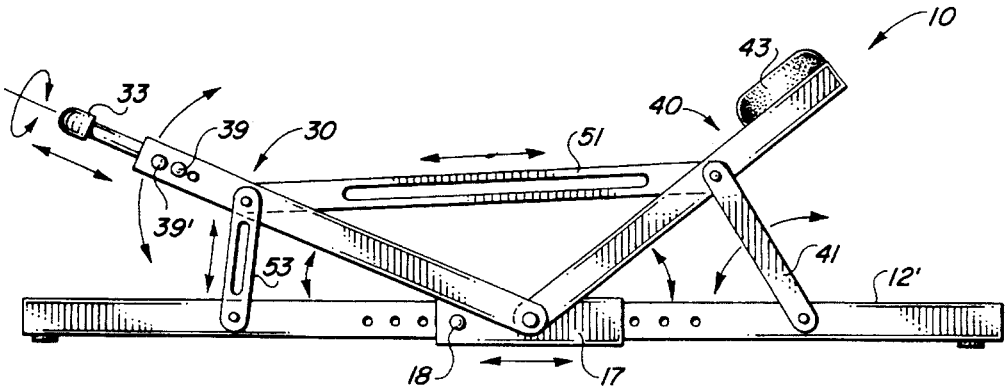
FIG. 2 is a side view of the exercise device of the present invention.
Figure 3:
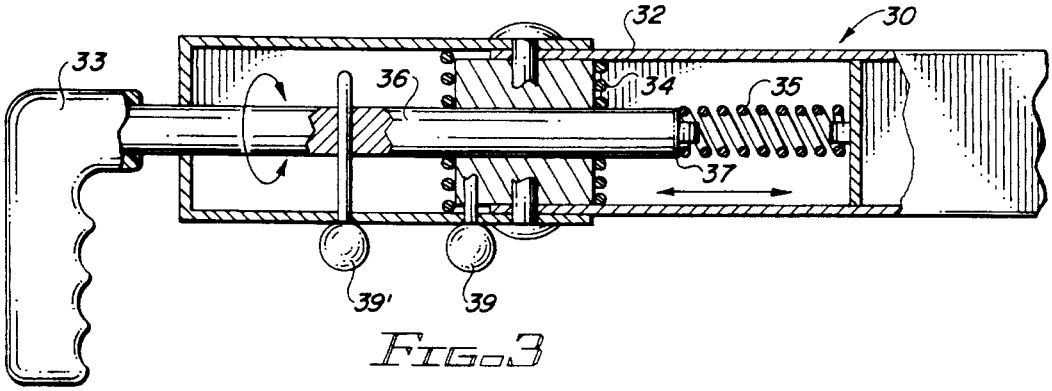
FIG. 3 is a cross-sectional view of the fore segment of the exercise device of the present invention.

Shown throughout the figures, the present invention is directed towards a multiple effect exercise device, generally indicated as 10. The exercise device 10 will preferably be formed of a strong yet light weight construction so as to facilitate long life after repeated exercising while providing for convenient transportability thereof. Included as part of the exercise device are a pair of elongated support rails 12 and 13, preferably disposed in a spaced apart relation from one another. The elongate support rails 12 and 13 preferably have a tubular type configuration and can be either of a fixed length or a varied length. When adapted to have a varied length, each support rail includes two or more interlocking, telescoping segments which can extend an overall length of the support rails. The interlocking segments will be structured so as to be locked in one of a plurality of extending positions by conventional locking means such as a lock pin, screw or bolt extending through the support rails, or biased lock pins which protrude from the elongated support rails, to maintain the desired length. Extending between the pair of elongated support rails is at least one but preferably a pair of connector segments 13 and 13'. The connector segments 13 and 13' are structured to maintain the support rails in a select spaced apart relation from one another and are accordingly preferably structured to provide for variable spacing between the pair of elongate support rails. In the preferred embodiment, the connector segments 13 and 13' will include adjusted means in order to provide the variable spacing between support rails. Preferably, the adjustment means include a pair of interlocking segments 14 and 15 which define the desired spacing. In particularly, the adjustment means include an exterior interlocking segment 14 and 14' and an interior interlocking segment 15 and 15' structured to be slidingly and interlockingly disposed relative to one another. Utilizing one or more lock pins 16, bolts, screws, clips or spring biased engagement pins the interlocking segments are secured in one of a plurality of rail spacing positions. The rail spacing positions are defined by the connector segments so as to enable the support rails to be disposed an ideal distance from one another wherein each support rail corresponds an arm of a user, as defined by the shoulder width of the user. As such, convenient exercise of both arms can be achieved for users of varying sizes and shoulder widths. Further, in order to preserve the compact, portable nature of the exercise device, the connector segments can be structured to at least partially collapse towards at least one of the support rails. For example, the connector segments can be hingedly secured to the respective support rails and locked in place such as through a lock pin when in use. When, however, the device is to be transported, the individual connector segments, or portions thereof, will collapse towards the support rails lessening the overall width of the exercise device. Alternatively, the interlocking segments of the connector segments may be compressed into one another so as to provide a minimum spacing between the support rails during transport. Also, the connector segments may be structured to be completely detached from the corresponding support rails for complete collapsibility of the exercise device.

Disposed atop of each support rails is an exercise member 30. Each exercise member includes a fore segment 30 and a rear segment 40 hingedly secured to one another and pivotally secured to the support rails. Accordingly, the fore segment and rear segment may freely move towards and away from one another as well as towards and away from the underlying support rails during exercising. Additionally, in the preferred embodiment, the pivotal movement will enable the exercise members to completely collapse atop the support rails in order to further facilitate compact storage and transport of the overall device. Although the exercise members may be structured to be completely detached from the corresponding support rails, in the preferred embodiment the fore and rear segments of the exercise members will independently collapse down atop the support rails or adjacent thereto. Further, the segments can include a C-type configuration to facilitate flat collapsing or can be secured to an inside or outside surface of the support rails to facilitate parallel, adjacent collapsing of the segments.

Turning to the fore segment of each of the exercise members, it includes a proximal end 31 and a distal end 32. Extending from the distal end will be a handle grip segment 33 which is structured to be conveniently and comfortably griped by a user. Preferably, the handle grip segment will have a hook type configuration, to facilitate comfortable positioning and gripping by the user, and an absorbent cushion surface. The handle grip segment is secured at the distal end of the fore segment by fastening means. These fastening means include biased pivot resistance means 34 and biased torsion resistance 35 means therein such that pivoted and torsional movement of the handle grip segment relative to the fore segment will be resisted. While the fastening means can be any conventional bolt or hinged type fastening means which will enable the appropriate hinged and torsional movement of the handle grip segment relative to the fore segment, the fastening means will preferably include an extension segment 36 extending from the distal end of the fore segment. This extension segment 36 can be disposed in surrounding relation to the fore segment, but will preferably protrude from a hollow interior of the fore segment 30 through its distal end 32. The extension segment 36 includes a first end 37 and a second end 38, the first end being secured to the fore segment and the second end being secured to the handle grip segment. In the preferred embodiment, the first end of the extension segment is secured to the fore segment by inwardly biased extension means 35, such as a spring or elastic cord. The inwardly biased extension means are specifically structured so as to resist biased pulling of the second end of the extension segment away from the fore segment utilizing the handle grip segment, while still allowing some pulling or extension of the extension segment from the fore segment in order to elongate a distance from the proximal end of the fore segment to the handle grip segment and provide some tension to the user's arm. As such, the exercise member will not only conform to users of slightly varying forearm lengths, but will also provide some resistance tension which when combined with further exercise manipulations will function to increase the overall effects of the exercise. Alternatively, the extension segment may be variably positioned relative to the fore segment through adjustable screws, bolts, clips or lock pins 39. In the preferred embodiment, the extension means will also include the biased torsion resistance means. The biased torsion resistance means 35 will preferably include a spring, or other like biasing means such as an elastic cord, disposed axially with regard to the extension means of the extension segment and can also function as the inwardly biased extension means 35. As such, while resisting biased pulling of the extension segment, resistance of the torsional movement of the extension segment and accordingly the handle grip segment relative to the fore segment will also be achieved. Not only will this resisted torsional movement function to strengthen the forearm during exercise, but also, this will function to enable proper and comfortable positioning of the arm during various stages of the exercise. For example, upon compressed movement of the forearm towards the shoulder the user's wrist will be twisted such that their palm is facing the shoulder during gripping of the handle grip segment, and conversely, the palm of the user's hand will face away from the shoulder when gripping the handle grip segment during an extension stroke of the user's arm. Accordingly, this will ensure that awkward, wrist concentrated pulling or pushing will not be promoted, and that the arm will be appropriately positioned to maximize the exercise effects. Further, because in certain occasions the user may not desire torsional movement of the handle grip segment, torsion lock means will also preferably be included to selectively prevent the torsional movement. In the preferred embodiment, these torsional lock means are in the form of a lock pin 39' or screw which extends through the fore segment and extension segment so to prevent relative torsional movement therebetween. In this preferred embodiment, the biased pivot resistance means will also be included with the extension segment 36 and preferably will be included at a hinged joint connection between the fore segment and the extension segment. Specifically, biased resistance means such as a spring or elastic cord are disposed about the hinged joint between the extension segment and fore segment thereby resisting pivoted movement there between. Similarly as with the biased torsion resistance means, pivot lock means are also preferably included in order to selectively prevent pivoted movement of the handle grip segment. Although the pivot lock means can take any of a variety of forms such as a locking collar or a pivot resistance wedge, the preferred embodiment includes a lock pin or screw to prevent resisted pivoted movement and this lock pin 39 can also function to allow the variable positioning of the extension segment 36 with the fore segment 30.

In order to achieve maximum comfort and appropriate positioning of the user's arm during exercising, the rear segment includes variable height support means which can adjustably secure the rear segment in a plurality of adjusted elevations relative to the support rail. In particular, when performing some exercises, it is optimal for the rear segment to be disposed parallel with the support rails, however, for other users who do not wish to have such a complete arm movement, the rear segment 40 is positioned at a higher, angled elevation to correspond the need and comfort of the user. In the preferred embodiment, the variable height support means include a support rod 41 disposed beneath the rear segments 40 of each of the exercise members 20 and structured to be secured in one of a plurality of variable height support positions. This support rod 41 can either be hingedly secured to the rear segment or to the support rails and will include a variety of interlocking positions in order to ensure that the appropriate height is maintained. Additionally, an arm rest 43 can be included on each of the rear segments to ensure that the user's arm is appropriately aligned and maintained relative to the exercise member. This arm rest 43, along with remaining portions of the exercise member may be padded for even further comfort and convenience.

In order to provide the resistance movement of the fore segment of the exercise member, horizontal and vertical resistance means are included. Preferably, the horizontal resistance means are disposed between each of the rear segments 40 of the exercise members and each of the fore segments 30 of the exercise members. Alternatively, however, the horizontal resistance means may be disposed directly between the support rails 12 and 13 at a rear end thereof, and the fore segment 30. The horizontal resistance means are structured such that movement of the fore segment 30 away from the rear segment 40 will be substantially resisted thereby exercising the user's arm. In the preferred embodiment the horizontal resistant means will include a spring 50 or elastic cord 51 or band structured to give the necessary tension and resistance appropriate for the particular exercise. Similarly, the vertical resistance means will also include preferably a spring 52 or elastic cord 53 or band and will be disposed to connect the fore segment 30 and a portion of the support rails 12 and 13 thereunder. As such, the vertical resistance means are structured to resist movement of the fore segment 30 towards the rear segment 40 and away from the underlying support rails 12 and 13. Although these are the preferred embodiments of the horizontal and vertical resistance means, in an alternative embodiment, the horizontal and vertical resistance means may include pistons. The pistons are structured to either provide substantial resistance upon expansion or upon compression. If resistance is substantially provided upon compression of the piston, the vertical resistance means will be structured to prevent movement of the fore segment towards the underlying support rail, whereas the horizontal resistance means will be structured to resist movement towards the rear segment and away from the underlying support rail.

In order to provide facilitated and rapid adjustments of the resistance provided during various stages of the exercise by the horizontal and vertical resistance means, each of the exercise members will preferably be adjustably disposed along the support rail. In the preferred embodiment, the exercise members will be secured to the support rail by a collar 17 disposed about the individual support rails 12 and 13 and locked into place by a removable screw, bolt, pin or like locking mechanism 18. As such, when greater or less resistance is desired on a particular stroke of the exercise, the individual exercise members can be adjustably moved towards or away from the connection point between the horizontal or vertical resistance means and the support rails. In this regard, moving the exercise member 20 towards the resistance means will increase the resistance and the length of the resisted movement whereas movement away from the resistance means will lessen the amount of resisted movement necessary in a particular exercise stroke. Additionally, the individual resistance means can be adjusted such as through implementation of larger or smaller springs or elastic bands as well as by adjusting the secured position of the resistance means.

The device of the present invention, as structured, is specifically designed to become compact and transportable such as in a small bag or suitcase, thereby enabling a user to bring it with them wherever they travel. As such, it will preferably have the light weight construction described above and can be used in any variety of fashions, such as by supportably resting the support rails on a table or other support surface for performance of the exercise. In such a case, the downward leverage resulting from the user's arms on the rear segments will maintain the exercise device securely in place during the exercise maneuvers. Alternatively, the exercise device can be positioned on the floor and the exercise strokes taken in a push-up type exercise wherein alternating arms are compressed and extended. Finally, the exercise device of the present invention can include mounting brackets so as to facilitate vertical mounting of the exercise device on a wall or vertical surface. As such, an individual can perform various exercises while facing the exercise device, or can turn their back to the device and achieve various arm extensions and curls utilizing the device. In such a case the rear segments alone will preferably collapse towards the support rails and/or in fact can be completely detached if necessary.

Now that the invention has been described,

What is claimed is:

1. An exercise device comprising:

(a) a pair of elongate support rails, said support rails being disposed in a spaced apart relation from one another, (b) at least one connector segment disposed between said support rails so as to maintain said support rails in said spaced apart relation, (c) a pair of exercise members, each of said exercise members being secured to one of said support rails and comprising:

a fore segment and a rear segment, said fore segment including a proximal end and a distal end, a handle grip segment extending from said distal end of said fore segment and structured to be gripped by a user, fastening means structured to secure said handle grip segment to said fore segment, said fastening means including biased pivot resistance means structured to enable resisted, pivoted movement of said handle grip segment relative to said fore segment upon pivoted movement of a wrist of the user gripping said handle grip segment, said fastening means further including biased torsion resistance means structured to enable resisted, torsional movement of said handle grip segment relative to said fore segment upon torsional movement of the wrist of the user gripping said handle grip segment, said fore segment and said rear segment being hingedly secured to one another and pivotally secured to said support rails, variable height support means structured and disposed to adjustably secure said rear segment in a plurality of adjusted elevations relative to said support rail, (d) vertical resistance means disposed between each of said support rails and each of said fore segments of said exercise members, said vertical resistance means being structured to resist movement of said fore segments away from said support rails, and (e) horizontal resistance means structured and disposed to resist movement of said fore segments away from said rear segments.

2. An exercise device as recited in claim 1 wherein said fastening means includes an extension segment extending from said distal end of said fore segment, said extension segment including a first end and a second end, said second end being secured to said handle grip segment.

3. An exercise device as recited in claim 2 herein said first end of said extension segment is secured to said fore segment by inwardly biased extension means structured and disposed to resist biased pulling of said second end of said extension segment away from said fore segment by said handle grip segment so as to elongate a distance from said proximal end of said fore segment to said handle grip segment.

4. An exercise device as recited in claim 3 herein said extension means are torsionally biased and include said biased torsion resistance means.

5. An exercise device as recited in claim 1 further including pivot lock means structured and disposed to selectively prevent pivoted movement of said handle grip segment.

6. An exercise device as recited in claim 1 torsion lock means structured and disposed to selectively prevent torsional movement of said handle grip segment.

7. An exercise device as recited in claim 1 wherein said exercise members are structured to collapse atop said support rails so as to facilitate compact storage and transport of the exercise device.

8. An exercise device as recited in claim 7 wherein said connector segment is structured to at least partially collapse towards at least one of said support rails.

9. An exercise device as recited in claim 7 wherein said connector segment includes adjustment means structured and disposed to enable variable spacing between said pair of elongate support rails.

10. An exercise device as recited in claim 9 wherein said adjustment means includes an exterior interlocking segment and an interior interlocking segment, said interior interlocking segment being structured to be slidingly disposed within said exterior interlocking segment so as to be secured in one of a plurality of rail spacing positions.

11. An exercise device as recited in claim 10 wherein each of said interlocking segments are structured to pivotally collapse towards a corresponding one of said support rails.

12. An exercise device as recited in claim 1 wherein said variable height support means includes a support rod disposed beneath said rear segment of each of said exercise members and structured to be supportably secured in one of a plurality of variable height support positions.

13. An exercise device as recited in claim 1 wherein said rear segment of each of said exercise members includes an arm rest.

14. An exercise device as recited in claim 1 wherein said horizontal resistance means are disposed between each of said rear segments of said exercise members and each of said fore segments of said exercise members.

15. An exercise device as recited in claim 1 wherein said horizontal resistance means and said vertical resistance means includes a spring.

16. An exercise device as recited in claim 1 wherein said horizontal resistance means and said vertical resistance means includes an elastic chord.

17. An exercise device as recited in claim 1 wherein said horizontal resistance means and said vertical resistance means includes a piston.

18. An exercise device comprising:

(a) a pair of elongate support rails, said support rails being disposed in a spaced apart relation from one another, (b) at least one connector segment disposed between said support rails so as to maintain said support rails in said spaced apart relation, (c) a pair of exercise members, each of said exercise members being secured to one of said support rails and comprising:

a fore segment and a rear segment, said fore segment including a proximal end and a distal end, a handle grip segment extending from said distal end of said fore segment and structured to be gripped by a user, fastening means structured to secure said handle grip segment to said fore segment, said fastening means including biased pivot resistance means structured to enable resisted, pivoted movement of said handle grip segment relative to said fore segment upon pivoted movement of a wrist of the user gripping said handle grip segment, said fastening means further including biased torsion resistance means structured to enable resisted, torsional movement of said handle grip segment relative to said fore segment upon torsional movement of the wrist of the user gripping said handle grip segment, said fore segment and said rear segment being hingedly secured to one another and pivotally secured to said support rails, variable height support means structured and disposed to adjustably secure said rear segment in a plurality of adjusted elevations relative to said support rail, (d) vertical resistance means disposed between each of said support rails and each of said fore segments of said exercise members, said vertical resistance means being structured to resist movement of said fore segments towards said support rails, and (e) horizontal resistance means structured and disposed to resist movement of said fore segments towards said rear segments.

19. An exercise device as recited in claim 18 wherein said horizontal resistance means and said vertical resistance means includes a piston.

* * * * *